United States Patent [19]

Fleischhacker et al.

[11] 4,178,055

[45] Dec. 11, 1979

[54] CONNECTING DEVICE FOR CONNECTING PAIRS OF WIRES

[75] Inventors: James E. Fleischhacker, Winston-Salem, N.C.; Henry G. Wasserlein, Jr., Seminole, Fla.

[73] Assignee: AMP Incorporated, Harrisburg, Pa.

[21] Appl. No.: 753,069

[22] Filed: Dec. 21, 1976

Related U.S. Application Data

[63] Continuation-in-part of Ser. No. 576,831, May 12, 1975, abandoned.

[51] Int. Cl.[2] ..... H01R 9/08

[52] U.S. Cl. ..... 339/98

[58] Field of Search ..... 339/95, 97–99, 339/276 SF

[56] References Cited

U.S. PATENT DOCUMENTS

| | | | |
|---|---|---|---|
| 2,964,171 | 12/1960 | Chadwick | 339/276 SF |
| 3,406,247 | 10/1968 | Parsons | 339/98 |
| 3,760,331 | 9/1973 | Gurley | 339/97 P |

*Primary Examiner*—Joseph H. McGlynn
*Attorney, Agent, or Firm*—Anthony S. Volpe

[57] ABSTRACT

Connector for connecting pairs of wires to each other comprises an insulating housing having oppositely directed wire-receiving ends. An electrical connecting device is mounted in each of the ends and wire admitting slots extend from each end partially across one wall of the housing. Corresponding wires of two pairs of wires are connected to each other by moving the wires laterally of their axes towards the wire-receiving ends, through the wire admitting slots, and into the connecting means. A plurality of such connectors are mounted on a continuous carrier strip which can be fed through a semi-automatic wire insertion apparatus. An alternative embodiment is disclosed for connecting a pair of tap wires to a pair of through wires.

3 Claims, 20 Drawing Figures

8
62
10
12
54'
50'
40'
56'
48'
42'
2
20'
16
54
50
40
18
20
22
44
42
3
26
30
28
32
34
34a
38
38a
36
36a
32a

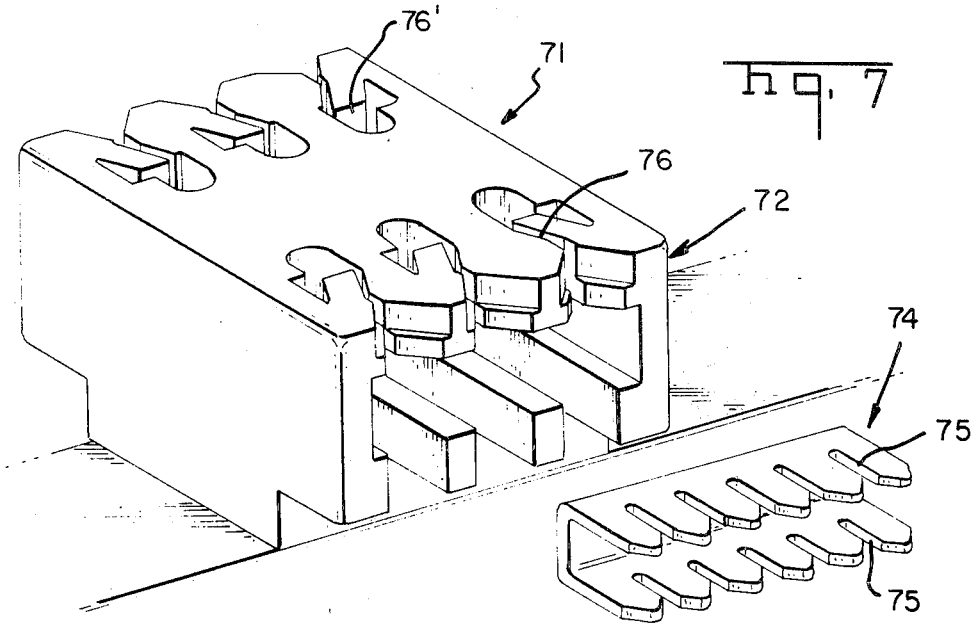
Fig. 7
Fig. 8
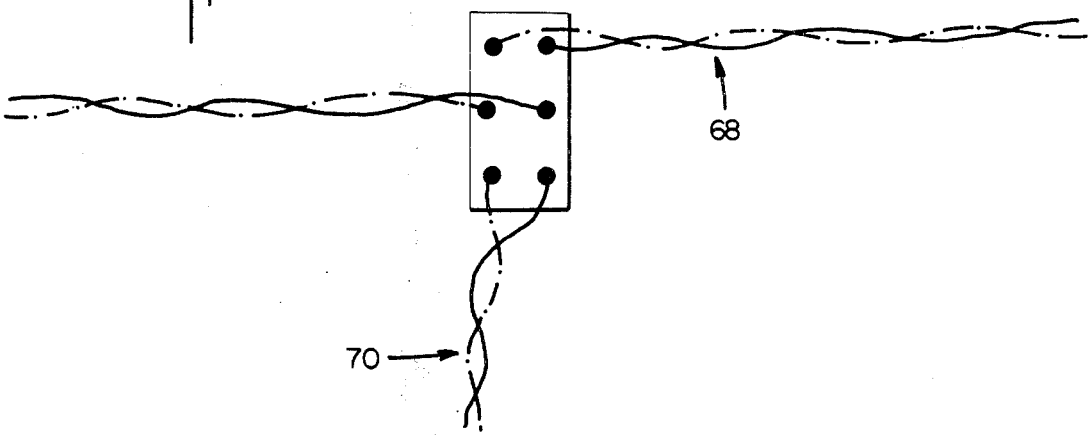
Fig. 8A
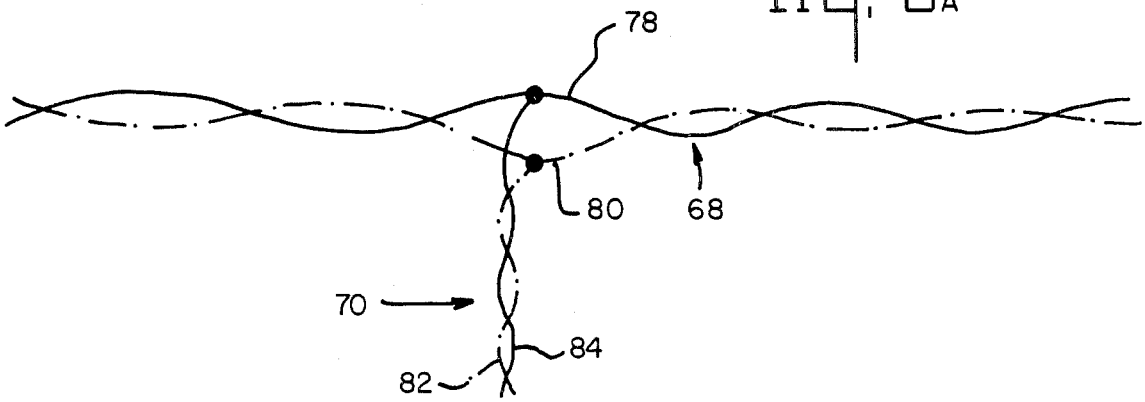

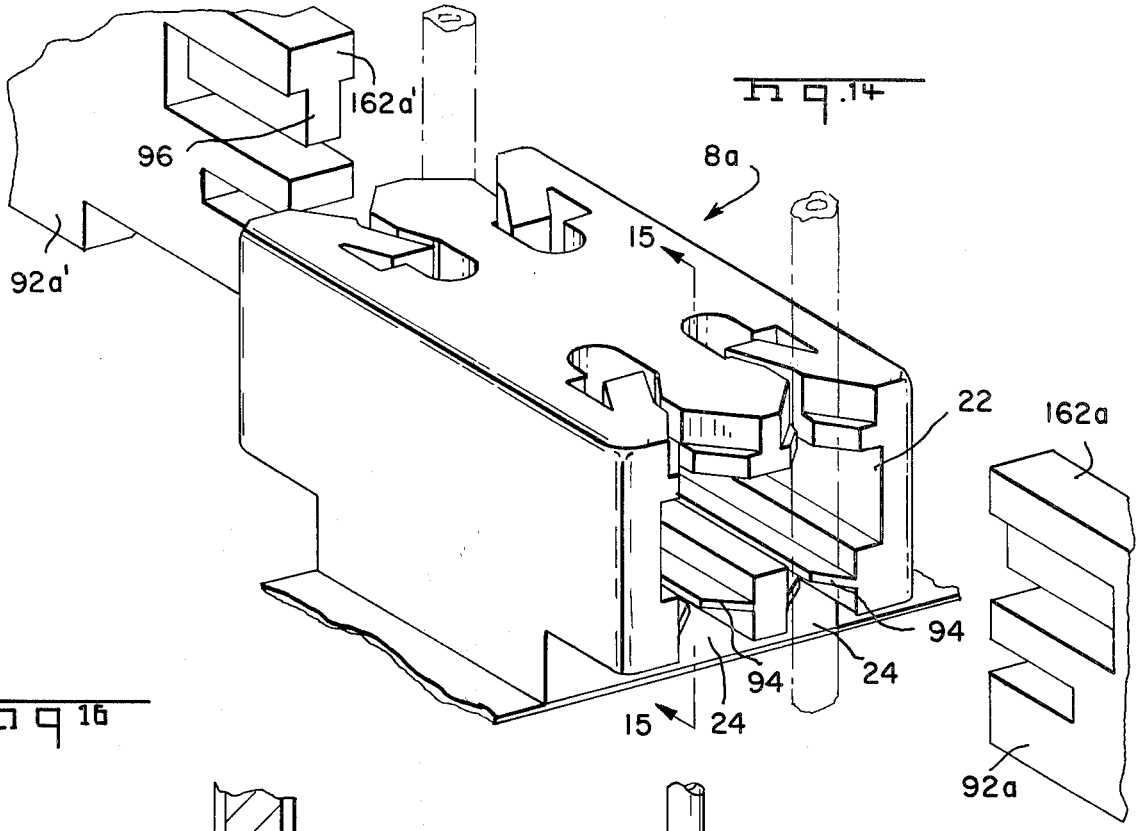
Fig. 14
Fig 16
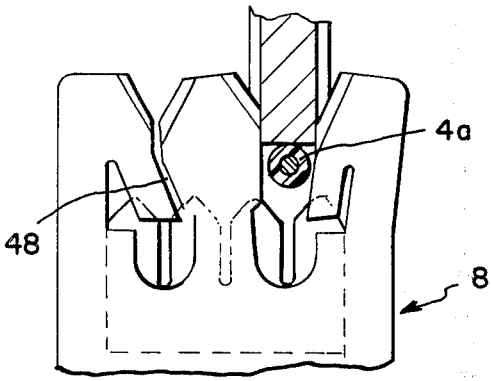
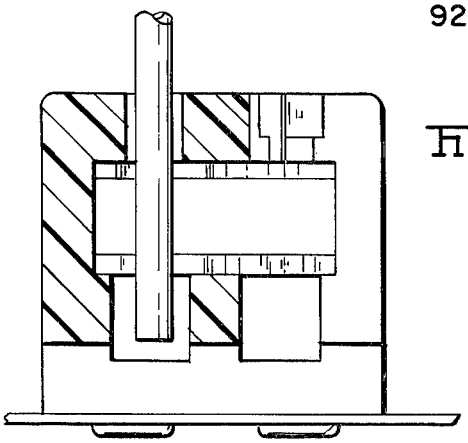
Fig 17
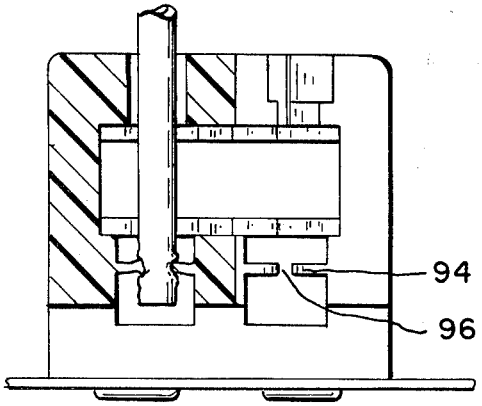
Fig 15

CONNECTING DEVICE FOR CONNECTING PAIRS OF WIRES

BACKGROUND OF THE INVENTION

This application is a continuation-in-part of application Ser. No. 576,831 filed May 12, 1975, now abandoned.

This invention relates to connectors for connecting corresponding wires of two pairs of wires to each other in separate electrical connections and to connectors for making tap connections to wire pairs. The invention is herein disclosed in an embodiment particularly intended for splicing multi-conductor cables of the type used in the telephone industry, however, the principles of the invention can be employed in connectors intended for other purposes.

The conductors used in the telephone industry for transmitting signals between widely separated locations are commonly provided as multi-conductor cables which contain varying numbers of pairs of conductors. The largest cables commonly used have about 4200 pairs of AWG 22 wires, although cables containing lesser numbers of wire pairs are also used.

Communications cables of this type are manufactured in discrete lengths, usually less than 1000 feet for the cables having the highest number of wire pairs, and it is therefore necessary to splice the ends of adjacent sections of cable when a new cable is being installed. It is, of course, also necessary to perform splicing operations when a cable is accidently cut or damaged. There are also many occasions when it is required that tap wires be connected to the wires in a telephone cable and these tap splices often involve all of the wire pairs in the cable.

It can be appreciated from the foregoing that cable splicing and cable tapping operations require a very large number of man hours on the part of the telephone companies and the achievement of cable splicing methods which can be carried out in a minimum amount of time is a continuing concern to the telephone industry. It can also be appreciated that there are several desiderada which the ideal telephone cable splice should have. The electrical connections between the corresponding wires in the two cable sections of a cable splice must, of course, be entirely satisfactory from an electrical standpoint and should have the life expectancy and reliability required in the telephone industry. In addition to these obvious requirements, the connecting means used should have as small a volume as possible since most connectors occupy more space than the volume of the wires being connected and a cable splice containing say 6000 or more individual connections will be quite bulky if the volume of the connectors is not severely limited. Cost is, of course, an important factor because of the vast number of connections required in a cable splice. Finally, the connector use should be such that the electrical connections can be made at a high rate and with a minimum amount of operator fatigue under circumstances such that the possibility of error in connecting the connection is minimized.

The instant invention is particularly directed to the achievement of a small volume connector which will serve to connect the two wires in each of two wire pairs to each other in separate electrical connections. The invention is further directed to the achievement of a connector which can be manufactured as part of a continuous strip and which is compatible with a semi-automatic apparatus which functions to insert wires into the connector to form the connections between the wires of two pairs of wires. An apparatus for connecting wires to each other by means of connecting devices in accordance with the instant invention is disclosed and claimed in U.S. Pat. No. 3,975,812.

It is accordingly an object of the invention to provide an improved connector for connecting corresponding wires of two pairs of wires to each other in separate electrical connections. A further object is to provide a connector comprising a single housing containing two isolated electrical connecting means, each of which is capable of connecting at least two wires to each other. A further object is to provide a connector in strip form which can be applied to wires with a semi-automatic wire connecting apparatus. A further object is to provide an improved connector for making tap type connections.

These and other objects of the invention are achieved in preferred embodiments thereof which are briefly described in the foregoing abstract, which are described in detail below, and which are shown in the accompanying drawing in which.

Figures 1, 1A:
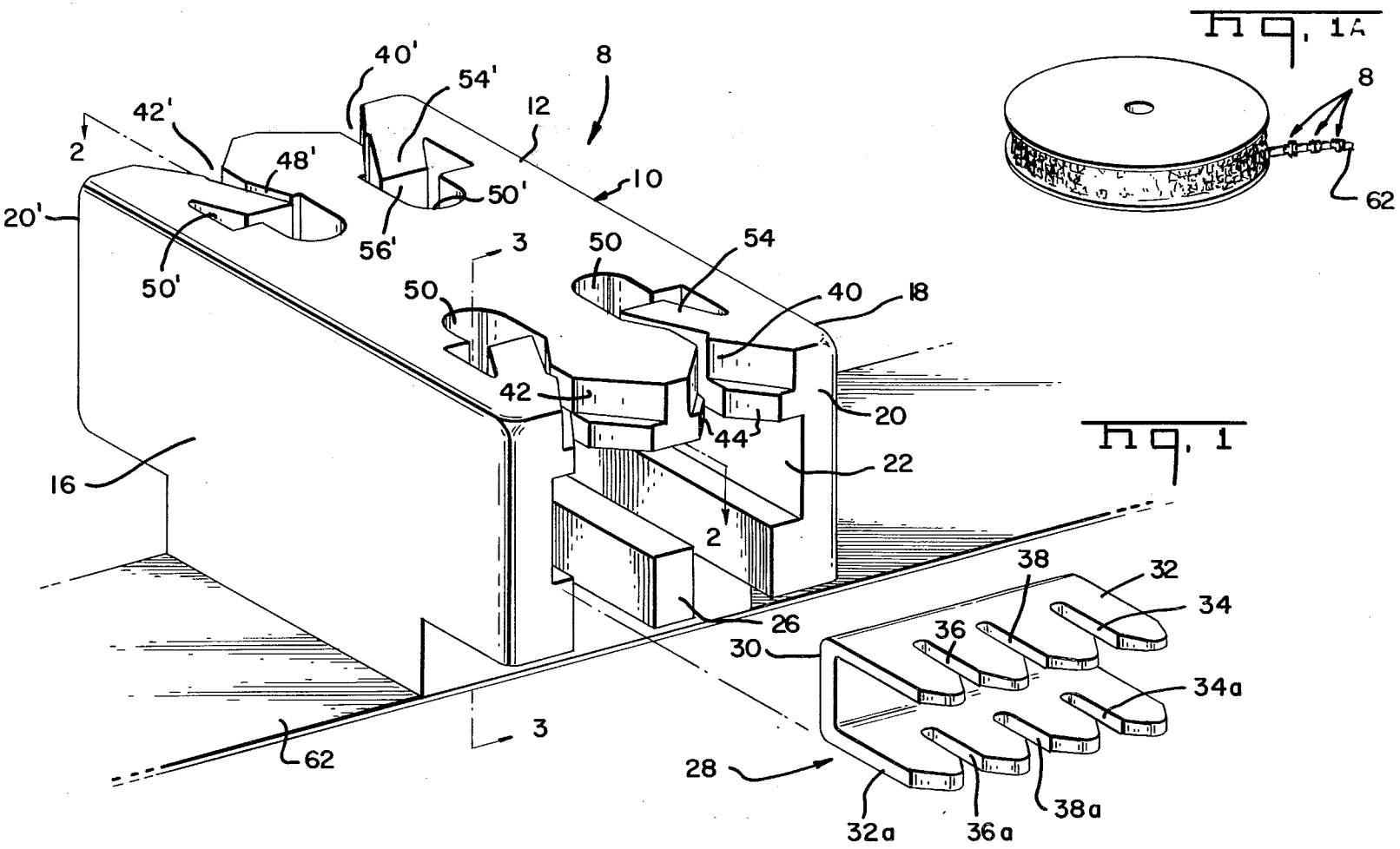
FIG. 1 is a perspective view of an electrical connector in accordance with the instant invention.
FIG. 1A is a perspective view of a reel of connectors of the type shown in FIG. 1.
Figure 2:
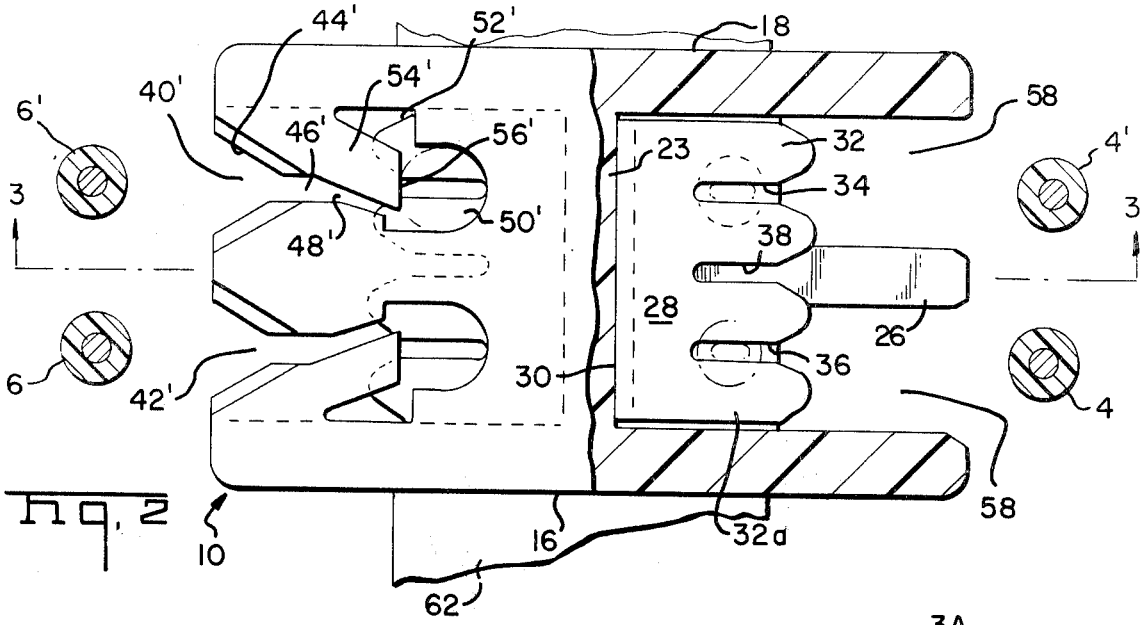
Figure 3:
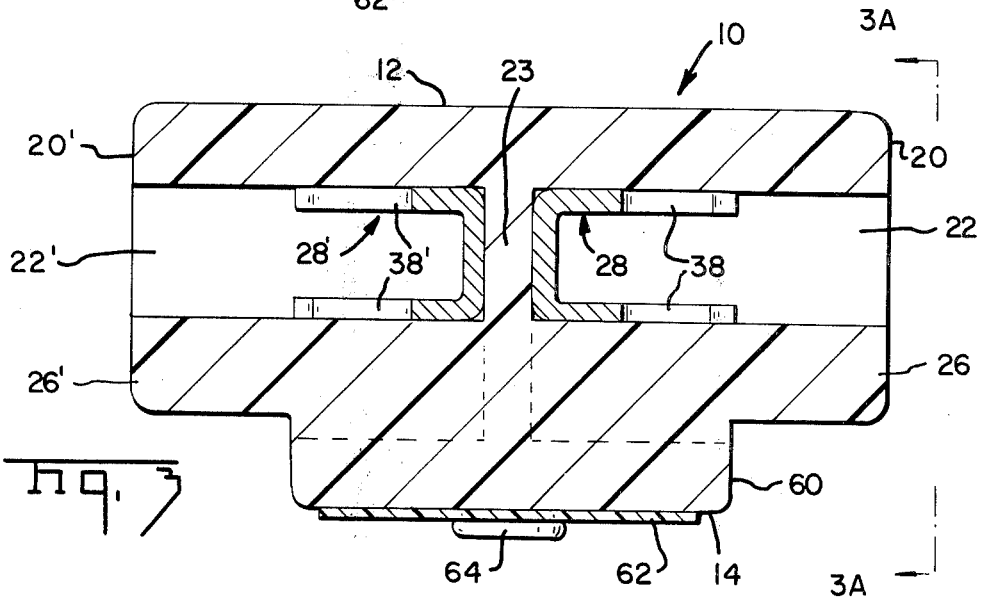

FIGS. 2 and 3 are views taken along the lines 2—2 and 3—3 of FIG. 1.

Figure 3A:
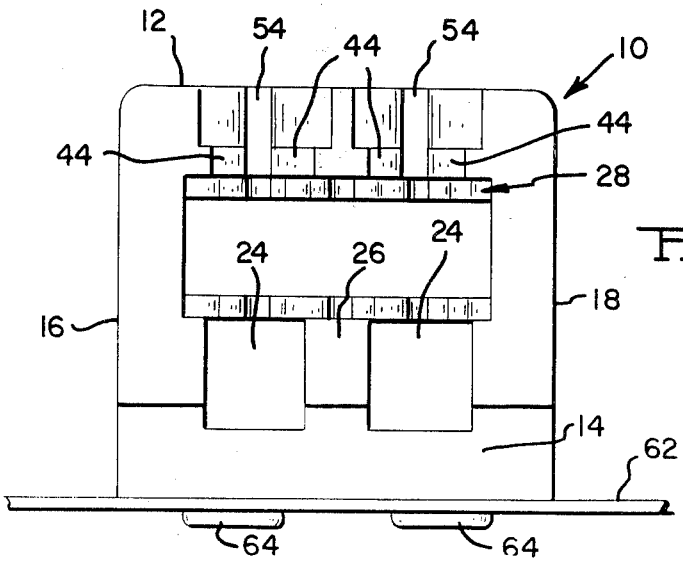

FIG. 3A is a view taken along the lines 3A—3A' of FIG. 3.

Figure 4:
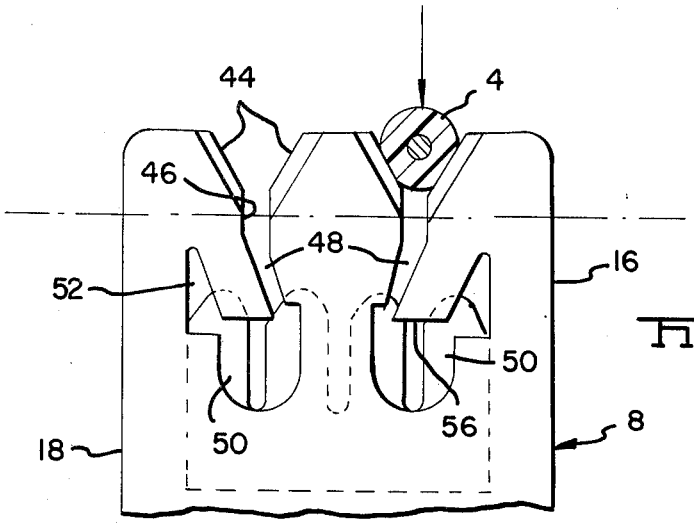
Figure 5:
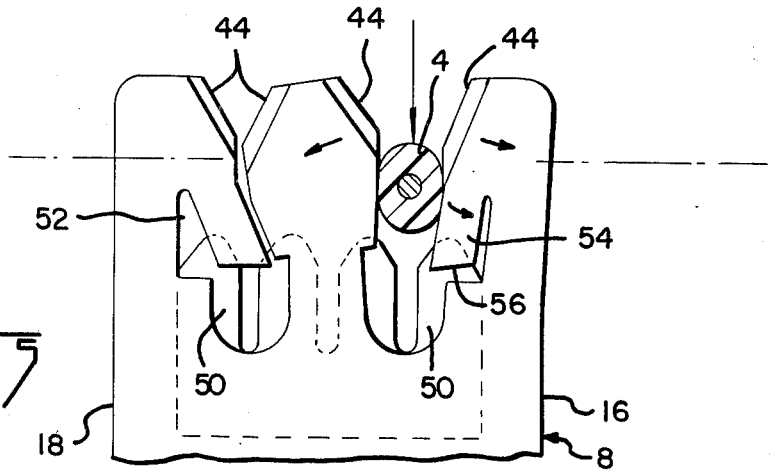
Figure 6:
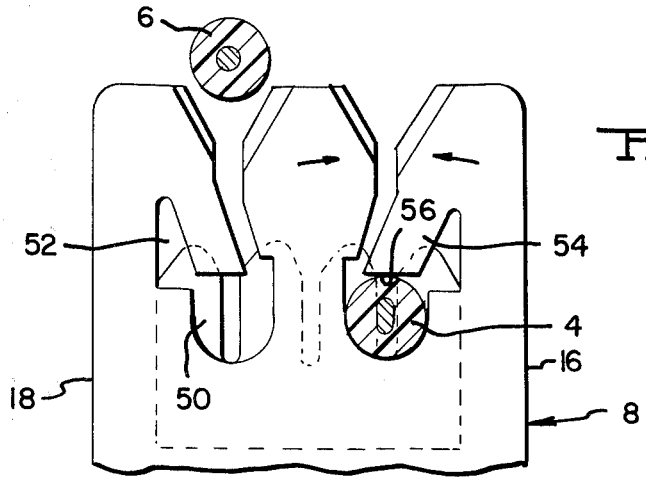

FIGS. 4–6 are fragmentary frontal views of a connector illustrating the movement of wires into one end of the connector.

FIG. 7 is a perspective view of an alternative connector which is intended for making tap connections to the wires of a twisting pair of wires.

FIG. 8 is a perspective view of a tap connection between tap wires and the wires of a pair.

FIG. 8A is a wiring diagram 6 of a tap connection.

Figure 9:
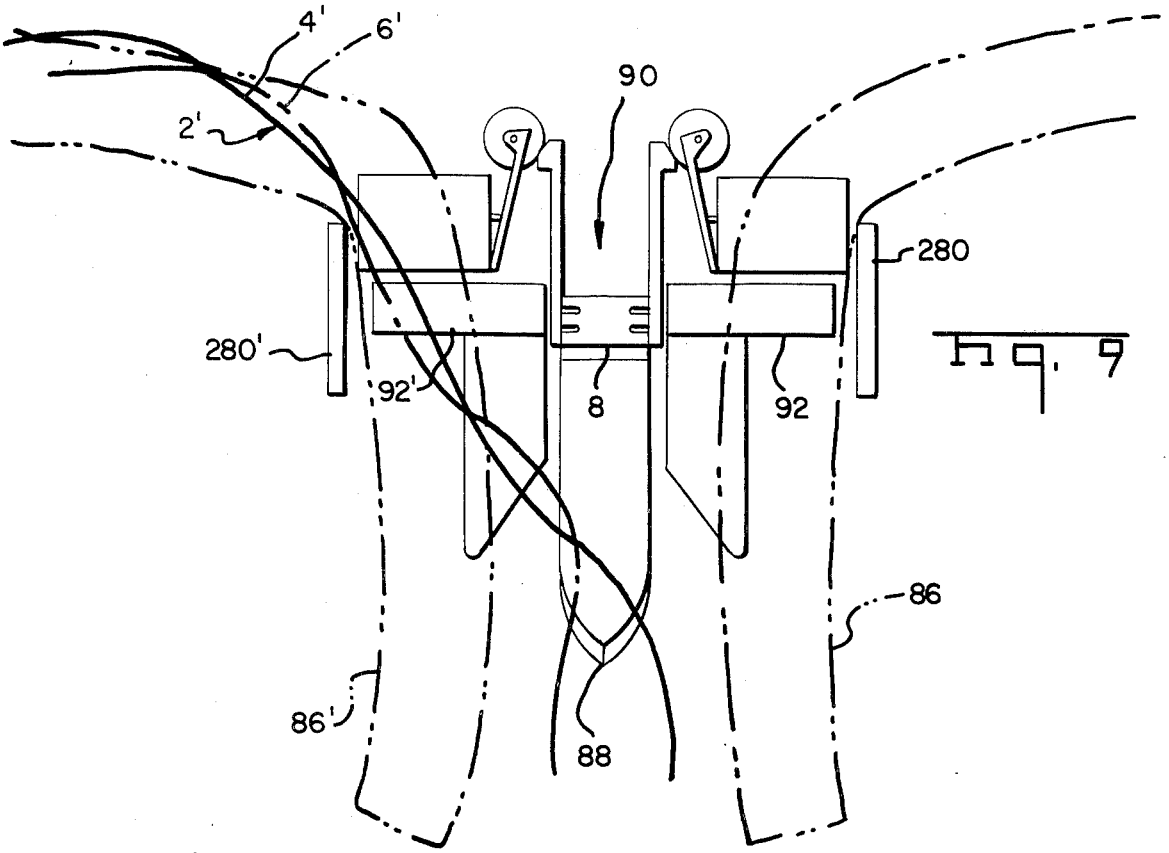

FIG. 9 is a semi-diagramatic top plan view of an apparatus illustrating the manner of positioning one pair of wires in the apparatus; this view illustrates the first step in the sequence of operations required to connect the corresponding wires of two pairs of wires to each other.

FIGS. 10–13 are views similiar to FIG. 9 illustrating the series of steps which are carried out to connect two pairs of wires.

FIG. 14 is a view similiar to FIG. 1 showing an alternative embodiment of the invention.

FIG. 15 is a view taken along the lines 15—15 of FIG. 14 but showing a wire inserted into the connector.

Figure 17:
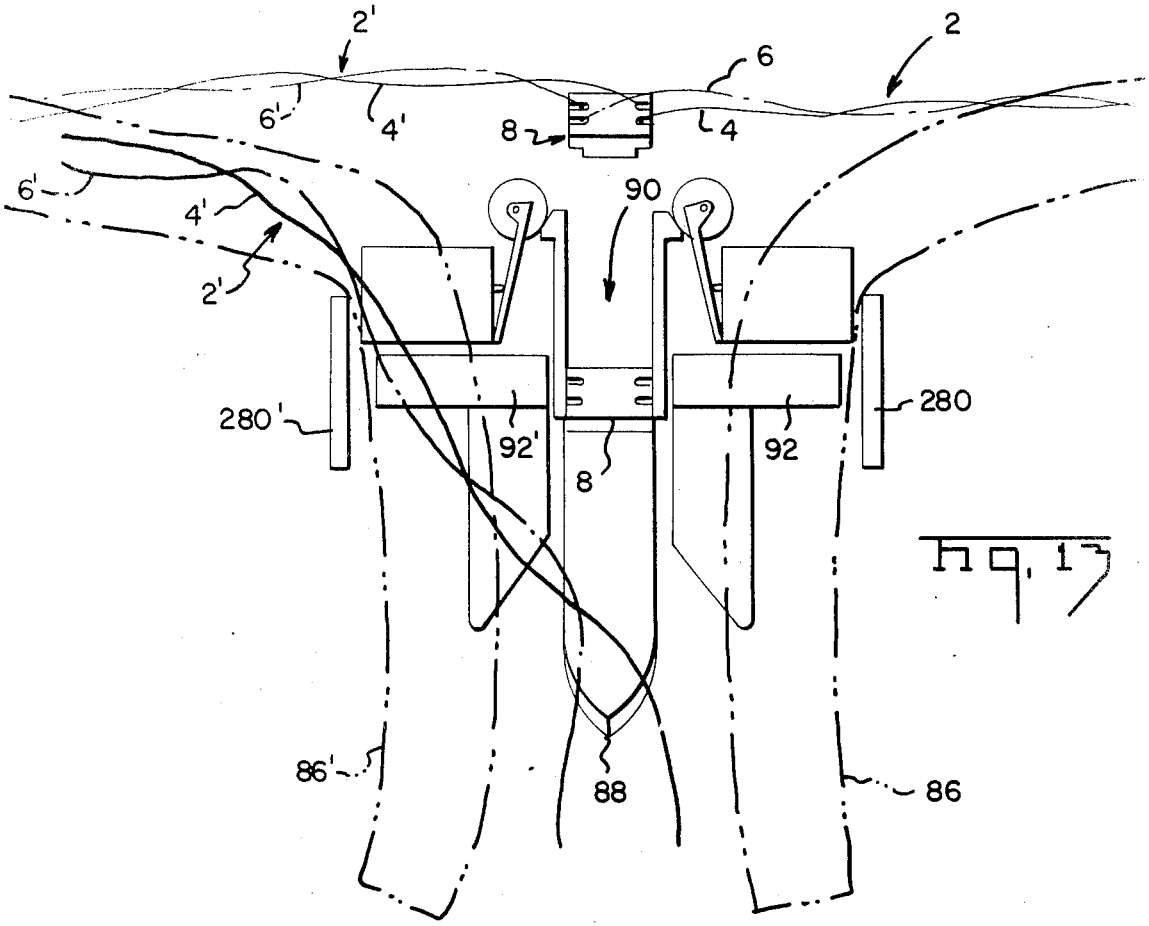

FIGS. 16 and 17 are views which illustrate a condition which is encountered when relatively small diameter wires are being inserted into the connector.

Referring first to FIG. 13, a connector 8 in accordance with the invention is normally used to connect the corresponding wires of two pairs 2,2' of wires to each other in separate electrical connections. Each pair 2 comprises insulated wires 4, 6 and each pair 2' comprises wires 4', 6'.

As shown in FIGS. 1–3A, the connector comprises a generally prismatic housing 10 having a front wall 12, a back wall 14, sidewalls 16, 18, and oppositely directed wire-receiving ends 20, 20'. The housing 10 is symmetrical about its central axis as shown by FIG. 2 and the same reference numerals, differentiated by prime marks, are accordingly used to denote corresponding structural features on the right and lefthand sides of this central axis.

Wire-receiving recesses 22, 22' extend into the wire-receiving ends 20 and are separated by a central barrier wall 23. Each recess 22 has a pair of spaced-apart extensions 24 (FIG. 3A) which extend towards the back wall 14 and which are separated by a barrier 26. These extensions receive the ends of the wires as will be described below.

A metallic electrical connecting device 28 is mounted in each recess 22 and is generally U-shaped having a web 30 and sidewalls 32, 32*a*. The sidewalls are provided with wire-receiving slots which extend inwardly from their free ends as shown at 34, 34*a*, and 36, 36*a*. The slots 36*a*, 34*a* are preferably relatively more narrow than the slots 34, 36 so that when a wire is moved laterally of its axis into a pair of aligned slots 36, 36*a*, or 34, 34*a* the narrower slot in the sidewall 32*a* will displace the insulation of the wire to a substantial degree and establish electrical contact with the conduction core. The edges of the wider slot in the sidewall 32 will penetrate and displace the insulation of the wire to a lesser extent. The slot in the sidewall 32 functions as a mechanical strain relief to protect the electrical contact against damage when an axial pull is applied to the wire.

Additional slots 38 in the sidewalls 32, 32*a* may be provided to permit flexure of the sidewalls when wires are inserted into the wire-receiving slots 34, 34*a* and 36, 36*a*.

The connecting devices 28, 28' fit snugly in the recesses 22, 22' with the sidewalls 32, 32' against the internal surface of the front wall 12. Wire admitting slots 40, 42 and 40', 42' extend inwardly from the ends of the housing in the front wall 12 to permit passage of the wires into the slots of the connecting devices.

Referring to FIG. 4, each of these wire admitting slots has an entrance portion having convergent edges 44 and this entrance portion merges with an intermediate portion 46 having parallel edges. Each slot extends obliquely as shown at 48 from the parallel edge portion to an enlarged inner end 50 with which the associated wire receiving slots of a connecting device 28 are in alignment. A recess 52 extends from the inner end portion 50 towards the adjacent sidewall 16 or 18 so that a portion 54 of the front wall can function as a flexible arm when the wire is moved into the device and through the wire admitting slot. The end 56 of this arm bears against the wire and prevents its unintentional removal.

The backwall 14 is cut away at its sides as shown at 60, FIG. 3, and the previously identified barrier 26 extends beyond the marginal side portion 60 of the backwall. These features permit the movement of tooling into wire receiving ends of the connecting device as will be described below. It should be added that in the completed cable splice, which contains a large number of closely packed connectors 8, the barriers 26 of the individual connectors serve the purpose of maintaining a minimum distance between adjacent connectors and particularly between the metallic connecting members 28 in adjacent connectors. It is desirable to maintain this minimum spacing for the purpose of preventing arcing or other undesirable electrical effects.

FIGS. 4–6 illustrate the movement of wires 4, 6 into one end of a connector 8. As shown by FIG. 4, the wire 4 is located in the entrance portion of the appropriate wire admitting slot with its axis extending transversely with respect to the associated metallic connecting device 28. The wire is moved laterally of its axis into wire admitting slot and simultaneously into the slots 34, 36 until it is fully inserted as shown in FIG. 6. During movement of the wire 4 through the wire admitting slot, the portion 54 of the front wall is flexed laterally and the central portion of the front wall is also resiliently deformed. After insertion of the wire is completed, the previously identified end 56 of arm 54 bears against the wire so that it cannot be moved laterally of its axis from the connector. It is thus apparent that two modes of strain relief are provided; the strain relief slot 34 or 36 protects the electrical contact against an axial pull on the wire and the arm 54 protects the wire against laterally directed forces.

It will be apparent from FIG. 6 that if the wires 4, 6 are inserted one at a time, the central portion of the front wall will be permitted to flex in the appropriate direction. However, all of the wires can be inserted simultaneously if desired and the center portion of the housing will be impressed.

Connectors in accordance with the invention are advantageously provided to the user on a continuous strip of thin film material 62 in spaced-apart relationship to each other with their wire-receiving ends 22, 22' facing laterally of the axis of the strip. The housings 10 are advantageously of a thermo-plastic material such as a glass-filled nylon which can be injection molded. The preferred manufacturing process is to provide holes in the carrier strip 62, feed the carrier strip through the mold of the molding machine, and mold the housings onto the carrier strip 62, the mold cavity having recesses to permit flow of molding material through the holes in the carrier strip so that studs 64 are formed on the underside of the carrier strip. The studs secure the housings 10 to the carrier but the individual housings are readily removed in the apparatus as will be described below. The carrier strip should be thin and flexible and should withstand the molding temperature of the material of the housing 10 without deterioration. Mylar (polyethyleneterephthalate) has been found to be a material which has the required properties and it appears to be ideally suited for connectors as shown. Alternatively, the carrier strip can be of thin steel in a suitable flexible temper or an alternative plastic material such as Kapton.

Figure 10:
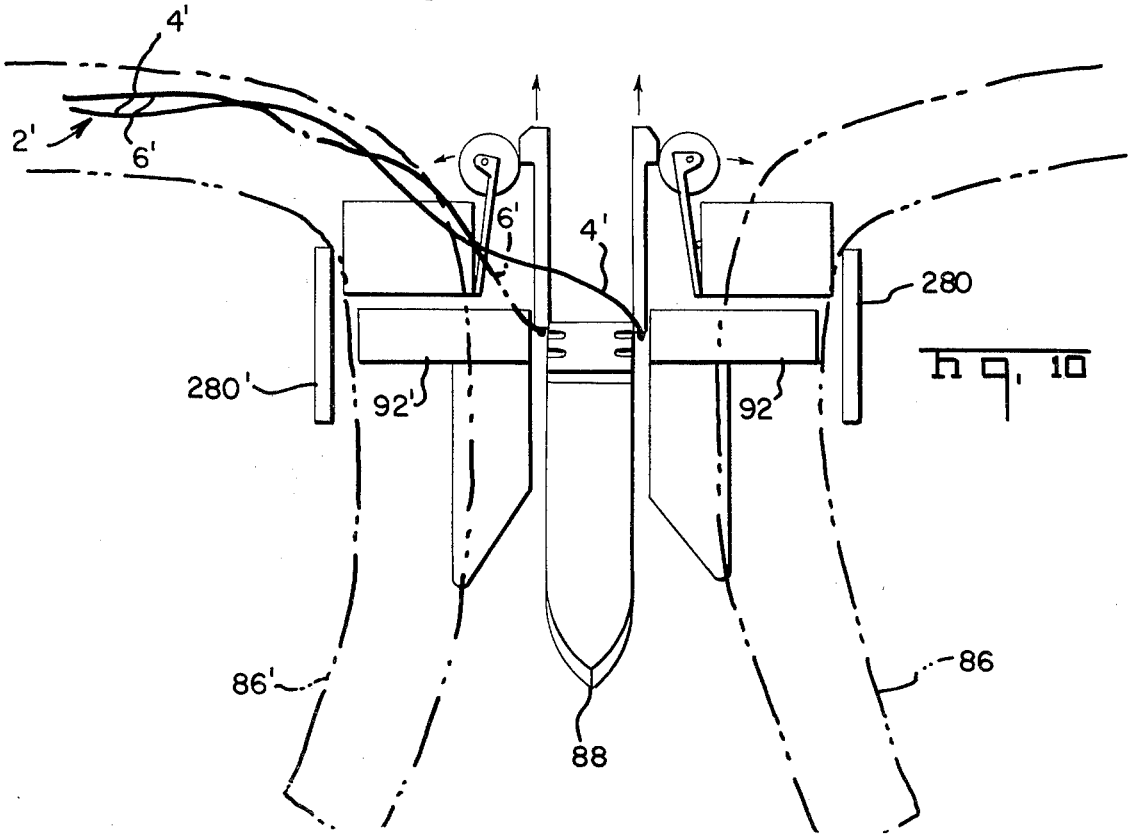
Figure 11:
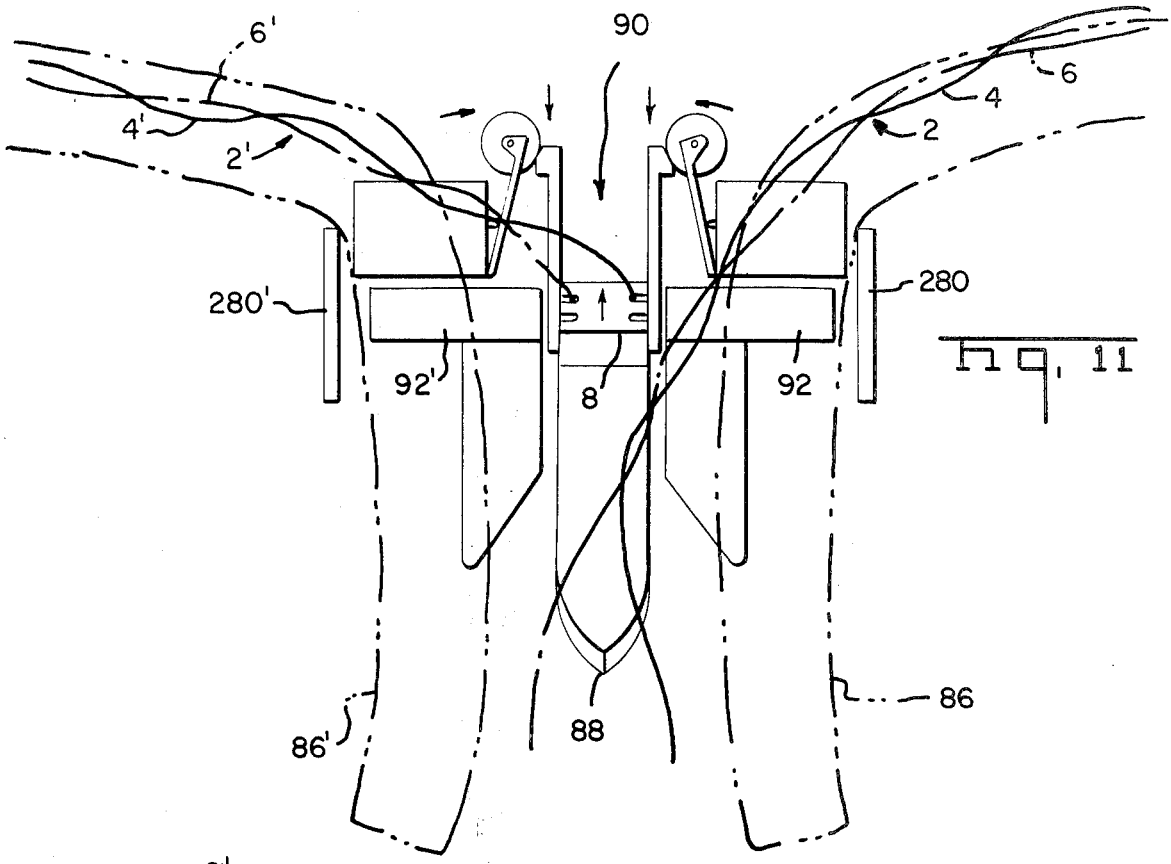
Figure 12:
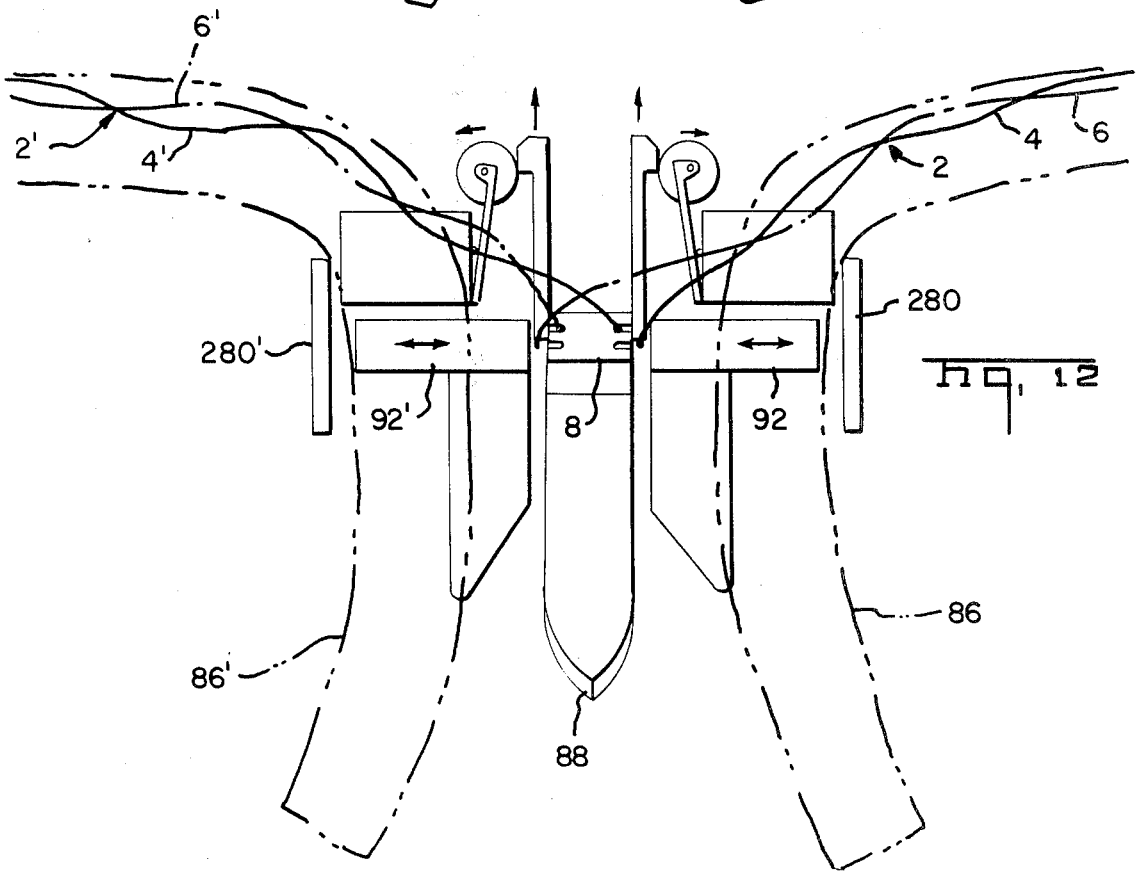

As noted previously, connectors in accordance with the invention can be applied to wires at a very high rate if an apparatus of the type shown and claimed in U.S. Pat. No. 3,975,812 is employed. The features of the connector strip disclosed herein which contribute to this high production rate can be appreciated from a review of FIGS. 9–13 which show diagramatically the essential structural features of the apparatus of U.S. Pat. No. 3,975,812 and which illustrate the handling procedures involved in a typical cable splicing operation when connectors in accordance with the invention are used. As shown in FIG. 9, a bundle of wire pairs 86, 86' from each cable will, during operation, be positioned on the upper end of the apparatus on each side of a wire splitter 88 and on each side of an operating or application zone 90. Wire-inserting and trimming punches 92, 92' are mounted in the operating zone on each side of, and in alignment with, the wire-receiving ends of a connector 8. The procedure which is followed to connect the corresponding wires of a wire-pair in the bundle 86' to a wire pair in the bundle 86 is to select a pair 2' from the bundle 86' and move the pair laterally from the bundle then downwardly over the splitter 88 until one wire is in alignment with each of the inserters 92, 92'. The inserters are then moved towards the connector 8 and the wires are trimmed and inserted into the wire-receiving ends of a connector as shown in FIG. 10. Thereafter as shown in FIG. 11, a pair 2 is selected from the bundle 86 and similarly moved over and past the splitter 88 until the wires are in alignment with the connector and the inserters. The inserters are again moved towards the connector, FIG. 12, to insert and trim the wires. At the conclusion of this step, the wire 4 will be connected to the wire 4' in the metallic channel shaped connector in the righthand portion of the connecting device 8 and the wire 6 will be connected to the wire 6' in the lefthand portion of the connecting device. At the beginning of the next operating sequence, the next adjacent connecting device is advanced to the operating zone and the connector which was previously installed on two pairs is ejected from the apparatus and delivered to a location between the ends of the cables from which the bundles extend.

It is expected that the method and apparatus of the invention will be used most of the time for cable splicing operations as described above. However, there are many occasions when tap wires must be connected to the wires of the cable intermediate the ends of the cable. Referring to FIG. 8A, a tap wire connection of a tap pair 70 to a through wire pair 68 is made by connecting the individual wires 82, 84 of the pair 70 to the wires 78, 80 of the through wire pair 68. The apparatus described above can be used to make tap type connections as shown in FIG. 8 by merely substituting connecting devices of the type shown in FIG. 7 for the previously described connecting devices of FIG. 1.

The connector 71 for making tap connections comprises a housing 72 is mounted on a carrier strip and which is generally similar to the previously described housing excepting that the individual metallic connecting members 74 each have three wire receiving slots 75 in each of their sidewalls and the front wall of the housing has three wire admitting slots 76, 76' as shown. The connecting device may have additional slots for permitting flexure of the sidewalls as shown.

When a plurality of tap connections are to be made to the wire pairs in a cable, the apparatus is set up adjacent to the cable as previously described and a bundle of wire pairs from the cable are positioned on one of the bundle supporting means on the upper end of the apparatus and beside the operating zone 90. The bundle of wires which are to be connected to the wires in the cable may be supported on the upper end of the apparatus on the other side of the operating zone.

The operator first selects a pair of uncut wires 68 from the bundle extending from the cable and moves the pair over the wire slitter and into the operating zone. When the inserters are actuated, the wires of the pair 68 will be cut and one of the cut ends of each wire will be inserted into the wire receiving slots at one end of each channel shaped metallic connecting means 74. The strip is then automatically indexed to locate the center wire-receiving slots 75 in alignment with the inserter. At this stage, the operator will have the free cut ends of the wires 78, 80 in his hands and he will move these wires over the splitter and into the operating zone 90. When the apparatus is again actuated, the inserters will trim these ends and insert them into the center wire receiving slots of the connecting devices 74. The individual wires 78, 80 of the through pair 68 will be uninterrupted electrically although the wires have been cut and the cut ends connected to each other by the connecting members 74. The strip is then advanced and the remaining wire receiving slots are positioned in alignment with the inserters. The operator then selects a pair 70 from the bundle of tap wire pairs, moves the wires of this pair over the slitter so that when the inserters are actuated, these tap wires will be trimmed and inserted into the connecting members. At the conclusion of this final insertion step of the cycle, the strip is advanced to position the next adjacent connecting device in the spacing zone as previously described.

FIGS. 14 and 15 show an alternative embodiment of the invention which is particularly intended for use where the connector is being used to splice relatively small diameter wires 4a as shown in FIGS. 16 and 17. A problem may be encountered with these small wires when a connector 8 of the previously described construction is used. This problem can be explained with reference to FIGS. 5 and 16; as shown in FIG. 5, during insertion of a relatively large diameter wire 4 into the connector, the portion 54 flexes as the wire passes through the passageway or slot 48 and the central portion of the connector housing also flexes so that the wire 4 is resiliently held during this critical period. After the wire is fully inserted as shown in FIG. 6, the wire is firmly held in the slot 34 in the metallic connecting device 28.

Under some circumstances the wires may be under a slight tension during trimming and inserting; that is, during movement of the wire into the connector as illustrated in FIG. 4–6, and if they are, it is important that the wires be held as shown in FIG. 5 during movement into the wire receiving slots and the connecting device 28. If the wires are not so held, the tensile force on the wire may cause it to move axially out of the slot 48 and the end portion of the wire will then not be moved into the wire-receiving slot in the connecting device 28. If the wire has a relatively large diameter as shown in FIGS. 4–6, a gripping force will be imposed on the wire, and the tensile force, if any, will be resisted. However, if the wire has a relatively small diameter as shown in FIG. 16, it will not be gripped during movement through the slot 48 and the tensile force on the wire may cause it to move axially out of the connector so that it may never be inserted into the wire receiving slot in the metallic connecting device 28. FIGS. 16 and 17 illustrate this condition with some exaggeration for purposes of clarity.

In order to obviate the undesirable condition shown and illustrated in FIGS. 16 and 17, a relatively thin membrane 94 is provided in each of the extensions 24 of the recess 22. These membranes extend transversely across the extensions 24 in planes which extend normally of the axis of a wire being inserted into the connector. The membranes 94 are provided with a central very narrow slot 96 which is in alignment with the wire admitting slots 40, 42 and the membranes extend substantially to the end surface 20.

When an extremely small diameter wire 4*a* is inserted into the recess 22 and into the slots 40, 42 in the housing, the wire, immediately after it is trimmed, will enter the associated relatively narrow slot 96 in the membrane 94. This membrane will then grip the wire as shown in FIG. 15 during its movement into a wire-receiving slot in the connecting device 28. With the wire thus gripped, it cannot move axially out of the connector, that is, it cannot move upwardly as viewed in FIG. 15, and it will complete its movement into the connecting device.

The membranes are relatively thin as shown in FIG. 15 and they do not offer substantial resistance to the movement of the wire laterally of its axis. It should be added that if a relatively large diameter wire is being used and the connector is constructed as shown in FIGS. 14 and 15, the membranes will collapse and will not impede movement of the wire into the connector.

The insertion punches 92*a*, 92*a'* which are used to trim the wires and insert them into the connector differ slightly from the insertion punches disclosed in the apparatus described in U.S. Pat. No. 3,975,812 in that the uppermost punch 162*a*, 162*a'* has a depending centrally located rib 96 which serves to open the wire admitting slot 48 in the housing. The punches are otherwise similiar to the punches fully disclosed in the above identified U.S. Pat. No. 3,975,812. The rib 96 has been found to be desirable in that it facilitates entry of the wires into the connecting device.

Connectors in accordance with the invention can be made in any desired size but the size will, of course, be maintained at a minimum level in the interests of achieving a minimum volume in the cable splice. One particular embodiment of the invention comprises a housing which is about 0.5×0.29×0.26". It must be remembered that each connector functions to form two electrical connections between the two corresponding wires of the pairs.

What is claimed is:

1. A connector for connecting the corresponding wires of two pairs of wires to each other in separate electrical connections comprising:

an insulating housing, said housing having oppositely directed wire-receiving open ends and having front and back wall means, and sidewalls extending between said ends, an internal barrier wall, said barrier wall being located between said open ends and extending from said front wall to said back wall, said barrier wall defining pockets in said housing which extend inwardly from said open ends to said barrier wall, each of said pockets having an electrical connecting means therein, each of said connecting means being receptive to at least two wires upon locating said wires adjacent to said open ends with the axes of said wires extending substantially normally of said front and back wall means and thereafter moving said wires laterally of their axes and into said wire-receiving open ends, each of said pockets having wire holding means therein disposed between said electrical connector means and said back wall, said front and back wall means extending past said connecting means in each of said pockets, said front wall means having wire admitting slot means extending partially thereacross from each of said wire-receiving ends towards said barrier wall whereby, upon locating the corresponding wires of said pairs adjacent to each end said connector and besides said wire-receiving open ends with portions of said wires extending substantially normally of said front wall means, upon moving said wires laterally of their axes towards, and into, said wire-receiving ends, and trimming said wires in the plane of said back wall means, portions of said wires move through said wire admitting slot means and into said pockets and are received by said electrical connecting means thereby electrically to connect said corresponding wires to each other.

2. A connector as set forth in claim 1, said wire holding means in each of said pockets comprising a membrane extending across said pocket, said membrane in each pocket having a membrane slot which receives said wire.

3. An electrical connector for connecting the corresponding wires of two pairs of wires to each other in separate electrical connections, said connector comprising:

an insulating housing having wire-receiving ends which face in opposite directions, a pocket extending inwardly from each of said wire-receiving ends, a front wall, a back wall, and sidewalls, said front wall, said back wall, and said sidewalls extending between said wire-receiving ends, and an internal barrier wall, said barrier wall being located between said open ends and extending from said front to said back wall, said pockets extending to said barrier wall, a metallic connecting member in each of said pockets, each of said connecting members comprising a generally channel-shaped member having a web and sidewalls, said sidewalls having free ends and having wire-receiving slots extending inwardly from said free ends, said connecting members being disposed in said pockets with said sidewalls parallel to said front and back walls of said housing and with said sidewalls directed towards said wire-receiving ends of said housing, wire admitting slots in said front wall extending inwardly from each of said free ends, each said wire admitting slots having an enlarged inner end which is in alignment with said wire-receiving slots in said metallic connecting members, said wire admitting slots having intermediate portions of reduced width which extend to said enlarged inner ends and to said wire-receiving ends of said housing, portions of said front wall which are adjacent to said intermediate portions being resiliently deformable to permit passage of wires therethrough, said enlarged inner end having an edge portion which adjoins said intermediate portion and which extends transversely with respect to said wire-receiving slots in said metallic connecting members thereby to prevent movement of said wire from said slot means after insertion whereby, upon locating the wires of each of said pairs in spaced-apart relationship with said connecting device between said wires and upon movement of said wires laterally of their axes and into said wire-receiving ends through said wire admitting slots, and into said wire-receiving slots in said metallic connecting members, said corresponding wires are electrically connected to each other.

* * * * *